United States Patent [19]

Thurston

[11] Patent Number: 5,046,885

[45] **Date of Patent: * Sep. 10, 1991**

[54] HINGED BARRICADE WITH LIMITING BOLT

[76] Inventor: Kurt W. Thurston, 475 Hill St., Reno, Nev. 89501

[ * ] Notice: The portion of the term of this patent subsequent to Apr. 23, 2008 has been disclaimed.

[21] Appl. No.: 526,226

[22] Filed: May 18, 1990

Related U.S. Application Data

[63] Continuation-in-part of Ser. No. 470,394, Jan. 5, 1990, Pat. No. 5,009,541, which is a continuation-in-part of Ser. No. 326,615, Mar. 21, 1989, abandoned, and a continuation of Ser. No. 383,298, Jul. 7, 1989, Pat. No. 5,003,912.

[51] Int. Cl.[5] ..... E01F 9/00

[52] U.S. Cl. ..... 404/10; 40/610; 116/63 P

[58] Field of Search ..... 404/6, 9, 10; 40/610; 116/63 P

[56] References Cited

U.S. PATENT DOCUMENTS

| | | | |
|---|---|---|---|
| 1,750,118 | 3/1930 | Mueller, Jr. et al. | 40/610 |
| 1,845,590 | 2/1932 | Edwards | 40/610 |
| 3,557,479 | 1/1971 | Allison et al. | 40/610 |
| 3,691,526 | 9/1972 | Huntington | 40/610 |
| 3,802,667 | 4/1974 | Kanan | 404/6 |
| 3,917,232 | 11/1975 | Lindner | 404/6 |
| 4,005,537 | 2/1977 | von Camber et al. | 40/610 |
| 4,085,762 | 4/1978 | O'Brian et al. | 40/610 |
| 4,231,676 | 11/1980 | Smith et al. | 404/6 |
| 4,253,260 | 3/1981 | Maza et al. | 40/610 |
| 4,279,105 | 7/1981 | Cameron | 404/6 |
| 4,298,186 | 11/1981 | Glass | 404/6 |
| 4,300,300 | 11/1981 | Neuland et al. | 40/610 |
| 4,372,536 | 2/1983 | Morse | 404/6 |
| 4,383,782 | 5/1983 | Pillifant, Jr. | 404/6 |
| 4,411,085 | 10/1983 | Farmer | 40/610 |
| 4,624,210 | 11/1986 | Glass | 404/6 |
| 4,796,369 | 1/1989 | Hamann | 40/610 |

*Primary Examiner*—Ramon S. Britts
*Assistant Examiner*—Roger J. Schoeppel
*Attorney, Agent, or Firm*—Flehr, Hohbach, Test, Albritton & Herbert

[57] ABSTRACT

A plastic barricade is rigidized with limiting bolt and hinge so that it can be open to a fixed freestanding position of, for example, 40°. Downward or collision forces with the barricade are compensated by providing compression molded end walls in the recesses in which the limiting bolt is placed. In addition, the hinge which includes a cylindrical male boss and a C-shaped female socket accommodates such forces by reason that the C-socket is also compression molded and includes additional strut means connected to its associated leg on the barricade frame unit for distributing any forces on the C-socket.

4 Claims, 5 Drawing Sheets

HINGED BARRICADE WITH LIMITING BOLT

CROSS REFERENCE TO RELATED APPLICATION

This application is a continuation-in-part of Ser. No. 07/470,394, filed Jan. 5, 1990, now U.S. Pat. No. 5,009,541, which is a continuation-in-part of Ser. No. 07/326,615, filed Mar. 21, 1989, now abandoned and a continuation of Ser. No. 07/383,298 filed Jul. 7, 1989 now U.S. Pat. No. 5,003,912.

FIELD OF THE INVENTION

The present invention is directed to plastic barricades and more specifically to one with a limiting bolt for effectively positioning the barricade in unfolded free-standing position and a rigidized hinge.

DESCRIPTION OF THE PRIOR ART

Plastic barricades are well known as, for example, shown in Glass U.S. Pat. No. 4,298,186. As described in that patent, one difficulty with a plastic barricade is that the plastic material of the hinges is more susceptible to breakage than the wood or metal type barricades. And such hinges have been used for the dual purpose of both allowing the frame members of the barricade to pivot from folded to an unfolded freestanding position and to limit the opening of the two frame units of the barricade to an angle, for example, 30°-50°, suitable for its intended use as a freestanding barricade. Wood and/or metal barricades, because of the nature of the material, resist breakage much more effectively for this limiting purpose. With a plastic barricade, various modifications of the hinge per se have been made, as shown in the Glass patent, to provide a limiting function. However, these techniques have not been altogether satisfactory.

In fact, when breakage has occurred, for example, in the hinge of a plastic barricade thereby allowing it to unfold to an undesired angle or be totally nonfunctional, a hole has been drilled near the hinge portion and a bolt inserted to limit movement. This was unsatisfactory in that the protruding bolt prevented effective stacking and the hinge, being still broken, made the barricade not fully operable or effective. (Or at least subject to more limited life.)

OBJECTS AND SUMMARY OF INVENTION

It is therefore a general object of this invention to provide an improved plastic barricade with effective limiting means for placing the barricade in a freestanding unfolded position, along with a rigidized hinge.

In accordance with the above object, there is provided a plastic barricade constructed from two substantially similar frame units each having a planar outside face and which are one piece, hollow, and integrally molded, such units being hinged together to pivot around a common axis of rotation. Each of the frame units has left and right legs. The improvement comprises hinge means at the top of each leg, each of said frame units including at the left leg a cylindrical male boss and at the right leg a C-shaped female socket for coupling onto the male boss and freely pivoting thereon. The hinge means normally allows the two frame units to freely pivot open or unfold to an angle substantially greater than a predetermined angle used when placing the barricade in a freestanding position. The barricade is maintained at the predetermined angle of the unfolded freestanding position by a pair of recesses in each frame in the planar outside face in each of said legs below the hinge means. Each recess has an aperture in its rear wall for accepting an elongated fastener having limiting means on both ends for abutting against the rear walls of the recesses when the barricade is unfolded to its predetermined angle. Both the C-shaped socket and the wall at the rear of the recess below the socket, which includes an aperture, are compression molded to form a solid resistance against downward forces on an unfolded barricade tending to both break the C-shaped socket and rip the fastener out of said recesses.

DESCRIPTION OF THE PREFERRED EMBODIMENT

Figure 1:
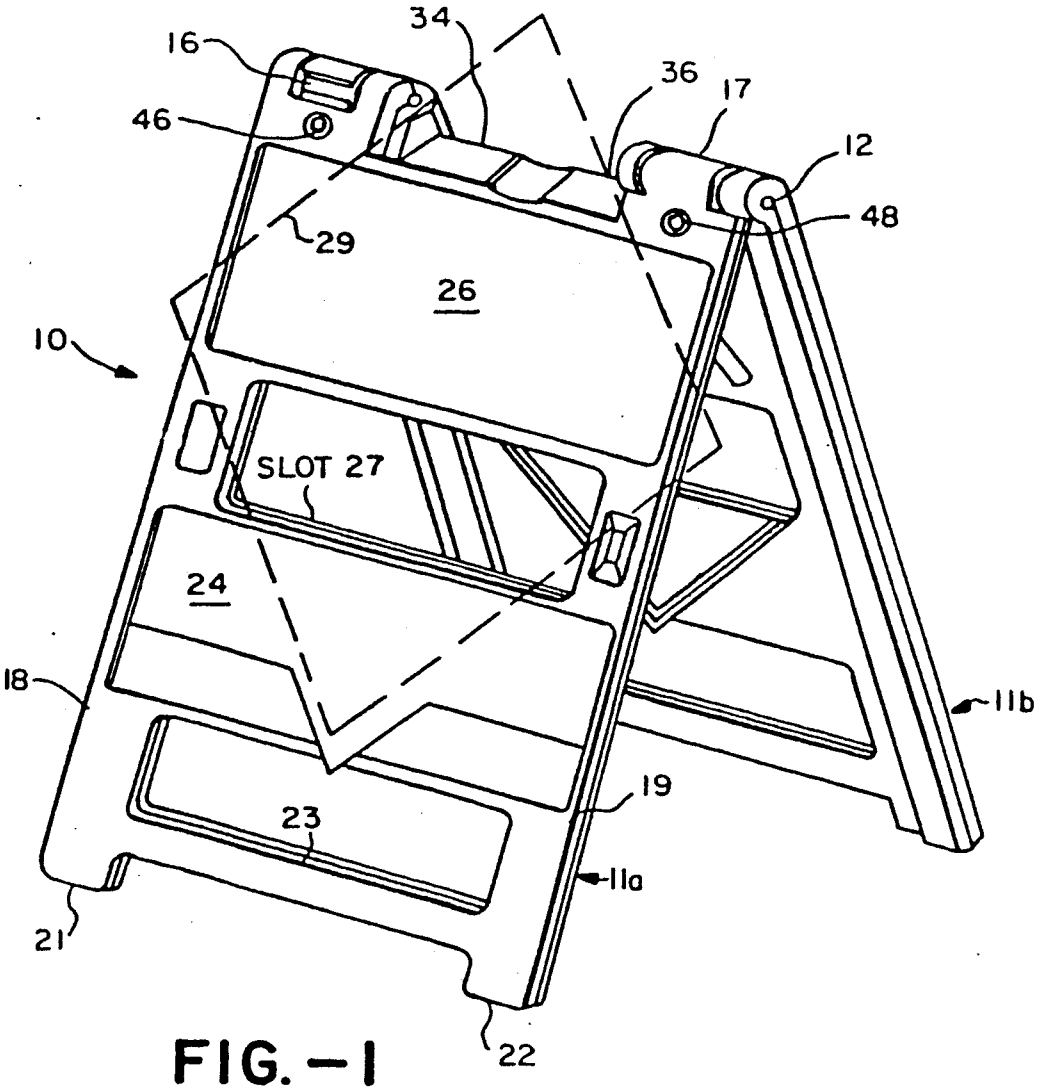
FIG. 1 is a perspective view of the plastic barricade of the present invention, showing it in an unfolded free-standing position.

FIG. 1 shows the plastic barricade of the present invention generally indicated by the numeral 10, which consists of a pair of identical generally planar frame units 11*a* and 11*b*. These units are one piece hollow integrally molded units. In general, such a frame unit is shown in the above-mentioned Glass patent. The frame units are hinged together at their top along the axis 12 which will be described in detail below. Since the units are substantially identical, this means that in the plastic molding process only a single die may be used, thus, considerably lessening costs.

Figure 2:
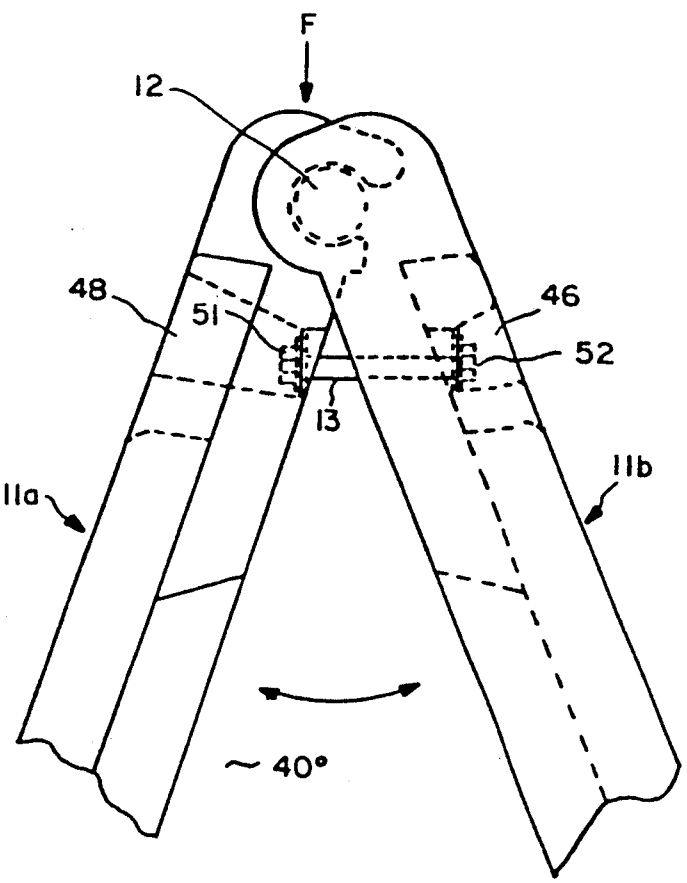
FIG. 2 is a partial side view of the top portion of FIG. 1.

Referring briefly also to FIG. 2, when the barricade is in its normal freestanding position, the two frame units are open to an angle of substantially 40°. The bolt 13 is used to limit the opening of the barricade to this position, as will be discussed in greater detail below. However, without the bolt, the left and right hinge means 16, 17 at the top of each frame member, allow the barricade to open or freely pivot to a much greater angle than the normal 40° angle; in fact, in the case of the present hinge, to substantially totally unfold to a position where both frame units 11*a* and 11*b* are in the same plane. Thus, this construction does away with any unwanted stress on the hinge member preventing it from being broken. For example, in one test the barricade was subjected to a downward force, F, of 350 pounds. Both the hinge survived and the bolts 13 did not rip out, but continued to maintain the opposed legs at their normal 40° angle.

Referring specifically to the detailed construction of a frame unit 11*a* (the other unit is identical, of course), it includes a left frame leg 18 and a right frame leg 19 which begin at the feet 21 and 22 which rest on the ground terrain and terminate in the hinges 16 and 17. Cross connecting the two legs 18 and 19 are a lower bar 23, a middle panel 24, and a top panel 25. In typical practice, both the top and middle panels may have a reflective material placed on them. In addition, the middle panel 24 may include a slot 27 into which the triangular point 28 of a road-warning sign 29 may be inserted, as illustrated in phantom.

Figure 3:
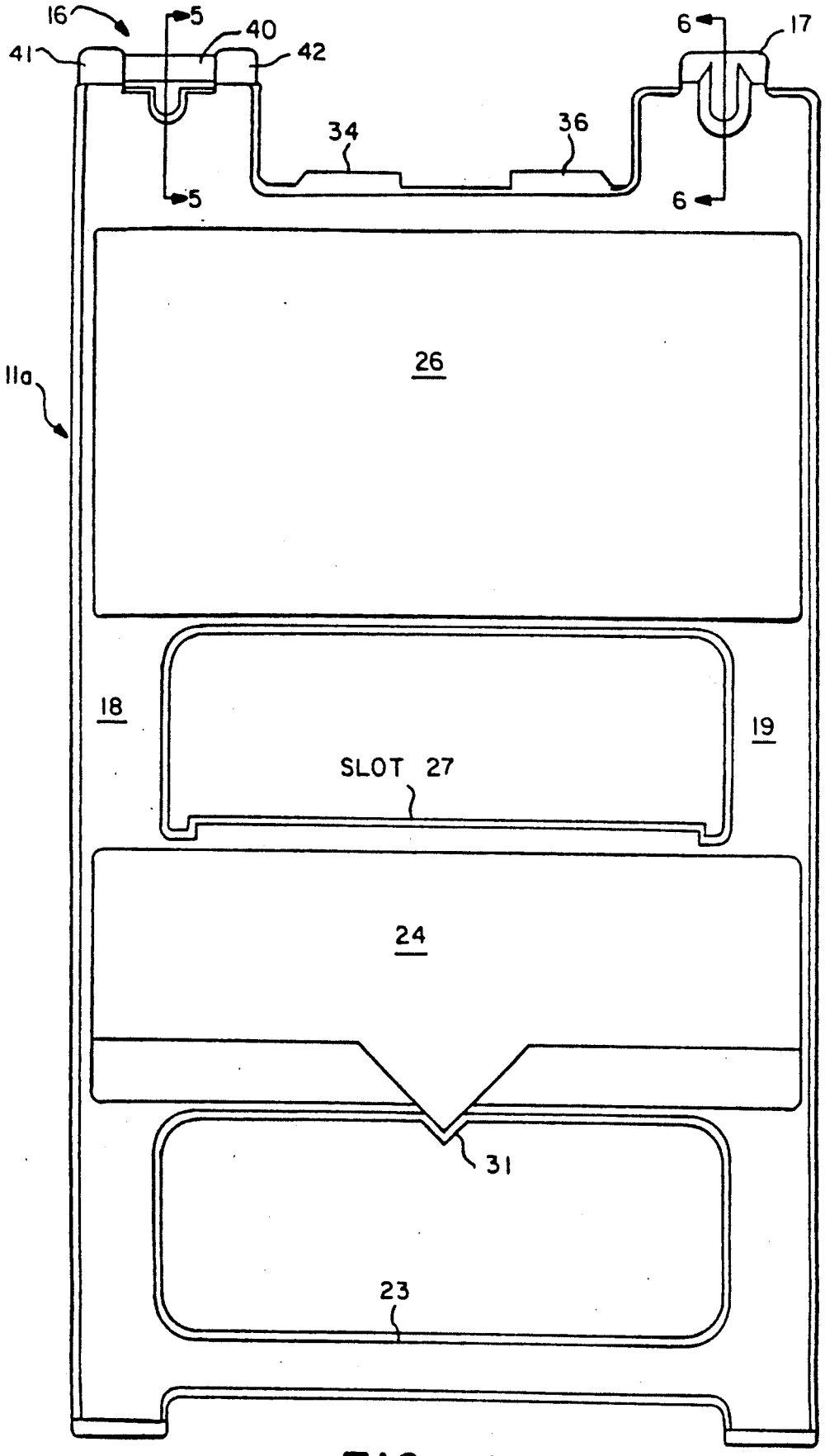
FIG. 3 is a plan view of the front or outside face of a frame member of the barricade.
Figure 4:
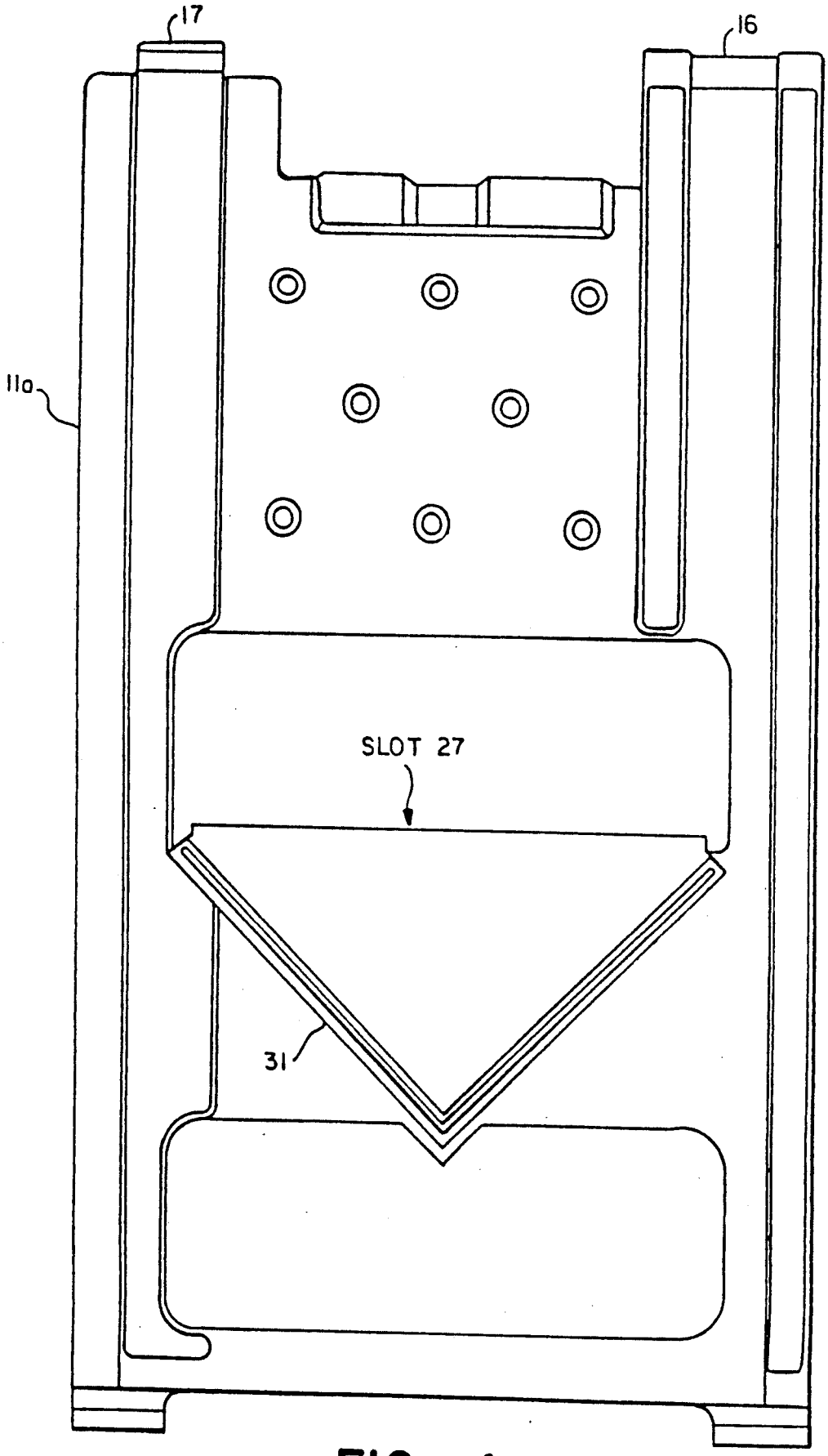
FIG. 4 is a plan view of the inside or back face of the same frame member.
Figure 6:
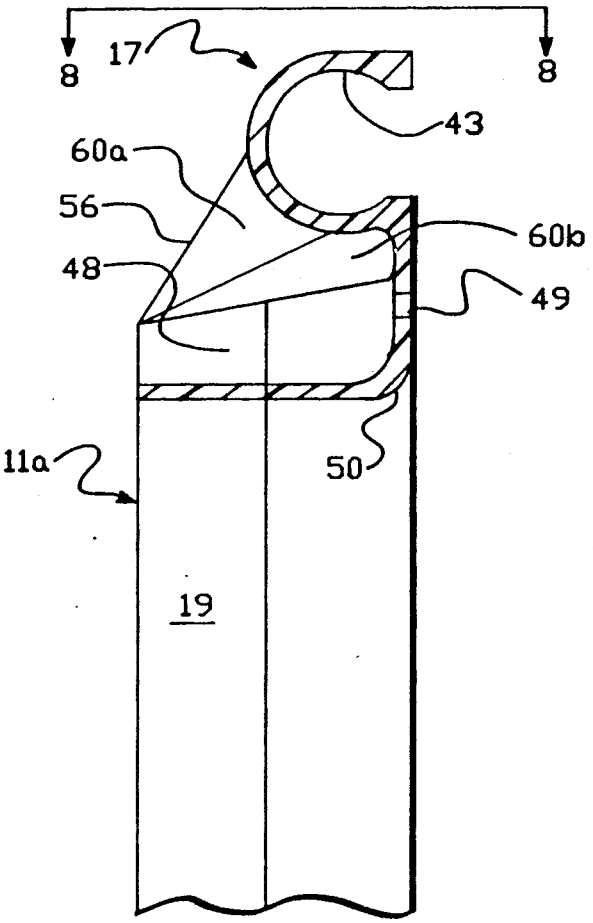
FIG. 6 is a simplified cross-sectional view taken along the line 6—6 of FIG. 3.
Figure 5:
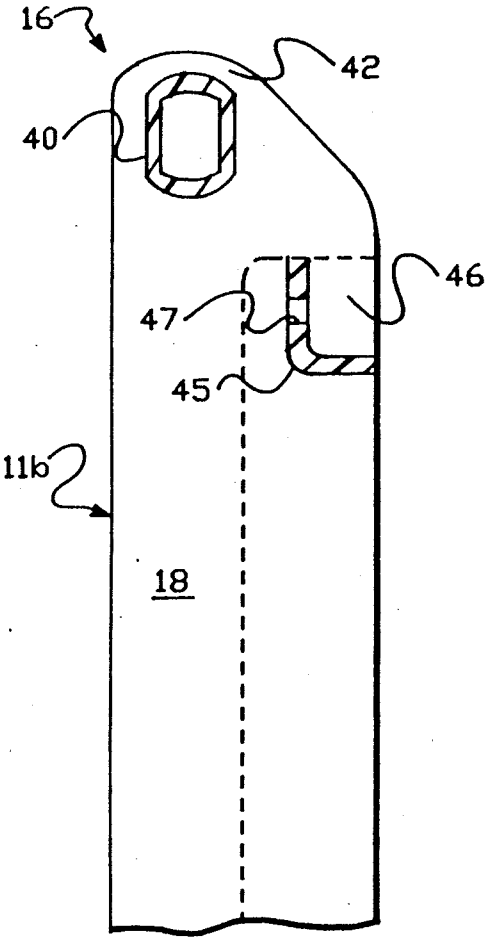
FIG. 5 is a simplified cross-sectional view taken along line 5—5 of FIG. 3.
Figure 10:
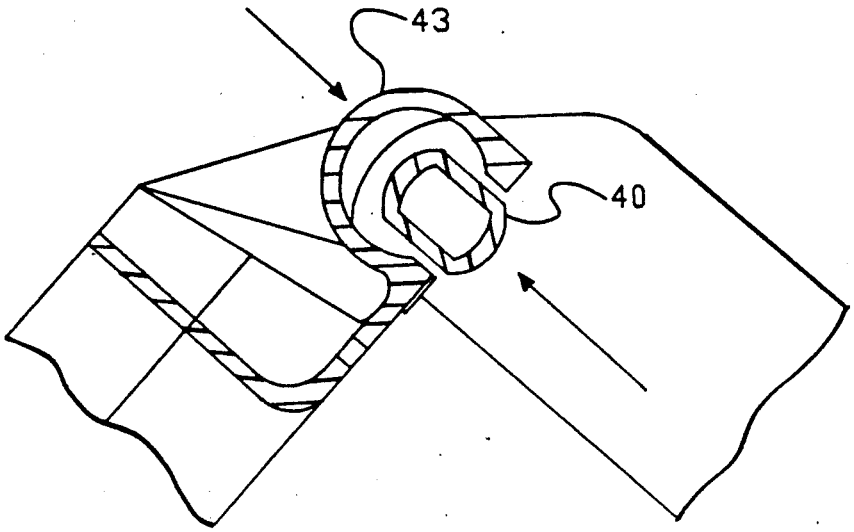
FIG. 10 is a cross-sectional view of FIG. 7 showing how the barricade is assembled.

At the top portion of the barricade between the hinges 16 and 17 are support surfaces 34 and 36 which are formed integrally with the frame member and which are horizontal when the barricade is in an unfolded position and can be used for the placement of warning lights. Typically a hole is drilled along axis 12 in the hollow boss type hinge 16 to allow a bolt to be inserted to retain a warning light. FIG. 4 shows the back of the same frame member 11*a*. Details of the hinges 16 and 17 are more clearly shown in FIGS. 5 and 6, which are cross-sectional views of the hinges, as illustrated in FIG. 3. Hinge 16, which is on the left side of the frame unit as shown in FIG. 3, includes a cylindrical hollow boss type unit 40 which is molded between supports 41 and 42. In FIG. 6 the hinge 17 includes an open C-shaped female socket 43. The open part of the C may of course be flexible so that it can be snapped onto the male boss 40. However, in the preferred embodiment, as shown in FIG. 10, boss 40 is flattened on diametrically opposed sides so that it will freely fit into socket 43 when the two frame units are at a 90° angle. Here, of course, no bolt 13 has yet been installed. Thus, there is free pivoting so that no unwanted forces are applied to the relatively fragile plastic hinge.

Figure 7:
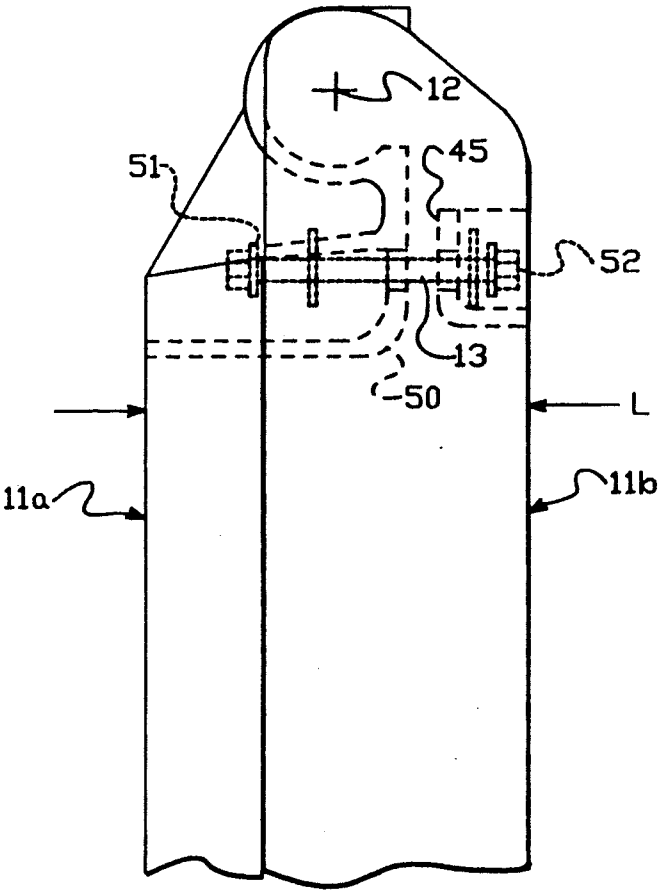
FIG. 7 is a side view showing FIG. 2 in a folded or closed position.

Below hinge 16 in leg 18 (see FIG. 5) is a recess 46 having a rear wall 45 within aperture 47 at its end. Similarly, in the case of FIG. 6 and hinge 17, there is a recess 48 with a rear wall 50 having an aperture 49. This provides a through aperture from one face of each frame member 11*a* (or 11*b*) from one side to the other. Thus, as is more clearly illustrated in FIG. 2, the limiting bolt 13 may be inserted therethrough and by the use of the bolt head 51 and the nut 52 on the other end (and washers, if necessary), this machine type bolt or equivalent fastener will limit the unfolding of the barricade to its predetermined freestanding angle which is indicated in FIG. 2 as substantially 40°. At the same time the length of the bolt type fastener 13, as illustrated in FIG. 7, is shorter or less than the distance between the planar outside faces of a folded barricade indicated as the distance L in FIG. 7. When the barricade is folded, as illustrated in FIG. 7, and another barricade stacked on it, the bolt will automatically be pushed to the neutral position shown in FIG. 7.

As illustrated in FIG. 1, there are, of course, because of the nature of the molding function, two locations—both recesses 46 and 48—in which the limiting bolt 13 can be placed. It is obvious that only one bolt need be placed for effective operation.

As illustrated in FIG. 2 and discussed previously, the downward force, F, is perhaps the most critical force to which the plastic barricade of the present invention can be subjected. This tends to stress the fastener 13 and its associated walls 45 and 50 (see also FIG. 7) to a maximum when the barricade is in its freestanding unfolded position where the fastener tends to rip out the plastic walls themselves. In other words, this is a critical stress point. In addition, the C-shaped socket 43 (best illustrated in FIG. 6) is a critical point in that it may tend to bend or crack. Thus, to strengthen these above critical portions, compression molding in the fabrication process of the barricade is utilized.

In general, of course, each frame unit of the barricade is hollow and produced by a blow molding process. This is done to lower the cost of plastic material and to enable the barricade to be filled with an inexpensive ballast, such as sand. Also, it simplifies transportation of the barricades.

The blow molding process is of course well known. In that process, when the opposing walls of the barricade are placed close enough by the die or mold used in the blow molding process (for example, twice the normal thickness) in effect a compression-molded continuous solid wall will result, such as the walls 45 and 50 as shown in FIG. 7 (and as shown in greater detail in FIGS. 5 and 6). In other words, the compression mold automatically results during the blow molding process if the walls are close enough. Of course other well known plastic fabrication techniques can be utilized.

With the compression molded walls 45 and 50, which form the end of the recesses 46 and 48, this provides an effective resistance against the force created by the bolt ends 51 and 52 (and their associated washers) in the unfolded position—especially where there is an external force being applied to the barricade—either downwardly or for example, by the impact of a vehicle.

Figure 9:
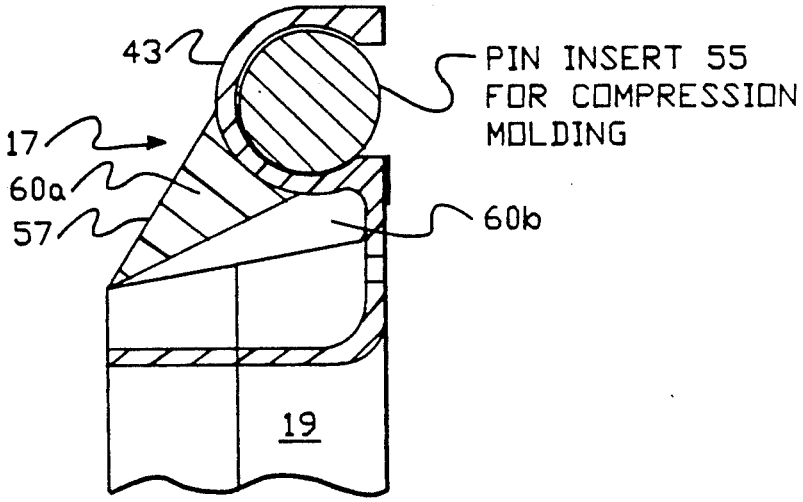
FIG. 9 is a simplified cross-sectional view taken along the line 9—9 of FIG. 8.

With respect to the C-shaped socket 43, it is desirable that the socket itself be compression molded, as illustrated in FIG. 9. This is accomplished by the use of a pin insert 55 which, during the molding process, is inserted in the cylindrical cavity formed by socket 43. Again, this is a well known technique in the plastic molding process.

Figure 8:
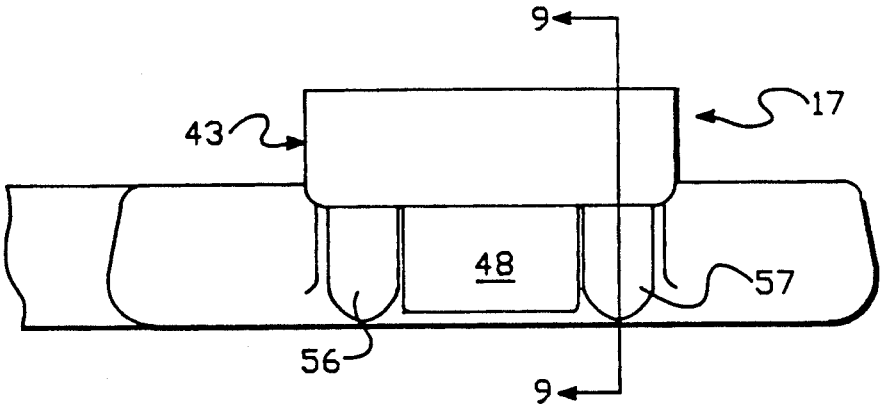
FIG. 8 is a top view taken along the line 8—8 of FIG. 6.

Finally, in order to effectively distribute forces on the compression molded C-shaped socket 43, a pair of struts 56 and 57 (as best shown in FIG. 8 and in the cross-section as shown in FIG. 9) are compression molded connecting the socket 43 diagonally with the leg 19. This pair of solid compression molded struts thus transmits downward force on the socket and the overall hinge 17 to the associated leg 19. Thus, any stress on the relatively thinner wall of socket 43 per se is distributed via the struts 56 and 57. As illustrated in FIG. 9, in the present embodiment the upper portion 60*a* of each strut 56 and 57 is compression molded (and thus cross-sectioned) and the lower portion 60*b* is still blow molded.

In summary, a rigidized plastic barricade with limiting bolt and hinge has been provided where, by use of compression molding, forces due to the limiting bolt holding the barricade in an open stance are effectively compensated and distributed; in addition, the unwanted forces are accommodated by the freely opening hinge and the use of compression molded support struts to distribute force on the hinge to the associated leg of the barricade.

What is claimed:

1. A plastic barricade constructed from two substantially similar frame units each having a planar outside face and which are one piece, hollow, and integrally molded, such units being hinged together to pivot around a common axis of rotation, each of said frame units having left and right legs, the improvement comprising:

hinge means at the top of each leg, each of said frame units including at said left leg a cylindrical male boss and at said right leg a C-shaped female socket for coupling onto said male boss and freely pivoting thereon said hinge means normally allowing said two frame units to freely pivot open or unfold to an angle substantially greater than a predetermined angle used when placing said barricade in a freestanding position;

means for maintaining said barricade at said predetermined angle of said unfolded freestanding position, including for each frame unit a pair of recesses in said planar outside face in each of said legs below said hinge means each said recess having an aperture in its rear wall for accepting an elongated fastener having limiting means on both ends for abutting against the rear walls of said recesses when said barricade is unfolded to its predetermined angle;

both said C-shaped socket and said wall at the rear of said recess below said socket, which includes a said aperture, being compression molded to form a solid resistance against downward forces on an unfolded barricade tending to both break said C-shaped socket and rip said fastener out of said recesses.

2. A barricade as in claim 1 where said other recess below said male boss includes a rear wall which is compression molded.

3. A barricade as in claim 1 where said C-shaped socket includes a pair of solid compression molded strut means for transmitting downward force on said socket and hinge means to said associated legs.

4. A barricade as in claim 1 where said cylindrical male boss includes diametrically opposed flattened sides which freely fit into said socket.

* * * * *